US007211721B2

(12) United States Patent
Boillot et al.

(10) Patent No.: US 7,211,721 B2
(45) Date of Patent: May 1, 2007

(54) SYSTEM AND METHODS FOR MEMORY-CONSTRAINED SOUND SYNTHESIS USING HARMONIC CODING

(75) Inventors: Marc A. Boillot, Plantation, FL (US); Radu C. Frangopol, Plantation, FL (US); Jean Khawand, Miami, FL (US)

(73) Assignee: Motorola, Inc., Schaumburg, IL (US)

( * ) Notice: Subject to any disclaimer, the term of this patent is extended or adjusted under 35 U.S.C. 154(b) by 269 days.

(21) Appl. No.: 10/964,385

(22) Filed: Oct. 13, 2004

(65) Prior Publication Data

US 2006/0075880 A1 Apr. 13, 2006

(51) Int. Cl.
*G10H 1/06* (2006.01)
*G10H 7/00* (2006.01)

(52) U.S. Cl. ..... 84/622; 84/603; 84/604; 84/608; 84/623

(58) Field of Classification Search ..... None
See application file for complete search history.

(56) References Cited

U.S. PATENT DOCUMENTS 5,536,902 A * 7/1996 Serra et al. ..... 84/623
5,886,276 A * 3/1999 Levine et al. ..... 84/603
6,111,181 A * 8/2000 Macon et al. ..... 84/603
6,140,566 A * 10/2000 Tamura ..... 84/609
6,169,241 B1 * 1/2001 Shimizu ..... 84/605
6,196,241 B1 * 3/2001 Doolan ..... 135/16
6,281,424 B1 * 8/2001 Koike et al. ..... 84/636
6,525,256 B2 2/2003 Boudet et al.
6,756,532 B2 * 6/2004 Wachi et al. ..... 84/604
2002/0134222 A1 * 9/2002 Tamura ..... 84/622
2003/0236674 A1 12/2003 Henry, Jr.

OTHER PUBLICATIONS

Portnoff, "Implementation of the digital phase vocoder using the fast Fourier transform," http://ieeexplore.ieee.org/xpl/abs_free.jsp?arNumber=1162810.
Laroche, "Synthesis of Sinusoids via Non-Overlapping Inverse Fourier Transform," IEEE Transactions on Speech and Audio Processing, 8:471-477, 2000.

* cited by examiner

*Primary Examiner*—Marlon Fletcher

(57) ABSTRACT

Systems (100 or 300) and methods (400 or 500) are provided for selecting a post-compression waveform from a post-compression waveform table (106) and supplying it to a synthesis engine (108). The post-compression waveform is based upon a set of post-compression coefficients determined by generating a frequency-domain representation of a periodic signal, the representation including at least one pre-compression frequency-domain sample (204), and performing a threshold-based compression of the pre-compression frequency-domain samples. Systems and methods also include indexing and storing (502) post-compression coefficients in a post-compression coefficient table (102), generating (506) a post-compression waveform based upon the set of post-compression coefficients, and placing (508) the post-compression waveform in the table prior to the selecting (510). The system and method also include performing (504) a read-ahead operation on a sound file before selecting the post-compression waveform, the read-ahead operation indicating the post-compression waveform to be selected and supplied to the synthesis engine.

17 Claims, 4 Drawing Sheets

SYSTEM AND METHODS FOR MEMORY-CONSTRAINED SOUND SYNTHESIS USING HARMONIC CODING

BACKGROUND

1. Field of the Invention

The present invention is related to the field of sound generation, and, more particularly, to generating musical sounds using wave table synthesis.

2. Description of the Related Art

Various sounds including musical sounds can be generated synthetically, or synthesized, by controlling certain sound-related attributes such as the frequency and timbral characteristics of an initial signal. In particular, devices for musical sound synthesis can control an input reference signal over a dynamic range so as to accommodate the frequency characteristics of different instruments performing a particular musical note or notes.

A sound synthesizer can be digital or analog in nature. One type of digital synthesizer implements a technique commonly referred to as wave table synthesis. In wave table synthesis, the synthesizer produces sound by playing back stored digital data. The stored digital data can be based on samples of an underlying periodic signal. The playback is digitally sped up or slowed down to alter pitch, thereby providing a range of pitch. Moreover, to generate sustained musical notes, a loop technique can be employed in which the data sequence repeats so as to extend the time of the synthesized musical note.

The sound synthesizer also typically includes an audio output device comprising various components such as time-varying filters, modulators, and oscillators that are used to generate acoustic sound signals, the acoustic sound signals being based upon the digital samples of the underlying periodic signal of a musical note performed by a particular instrument. The sound synthesizer is thus able to mimic the sounds of the musical instrument by electronically controlling the various components of the audio output device in accordance with the parameters dictated by the digital samples.

Computer or processor-based musical sound synthesis can be effected, for example, by processing a sound file that conforms to a protocol such as the Musical Instrument Digital Interface (MIDI). A MIDI-conformable device typically includes a MIDI sound engine for processing a MIDI sound file. In processing the sound file, the MIDI sound engine ordinarily accesses waveforms stored in a MIDI wave table. The MIDI wave table stores sampled sound data for playback during a MIDI-based synthesis. The MIDI sound file specifies a note or notes, the instrument on which the note or notes are played, and the duration of the musical note or notes.

Musical sound synthesis by the MIDI-conformable device, entails the MIDI sound engine performing a look-up operation for the sampled sound data, or waveform, corresponding to the musical note or notes of a musical instrument that the sound file indicates is to be synthesized. The selected waveform dictates the parameters that are used by the sound engine to control the sound output device. Thus, based on the parameters of the waveforms, the MIDI sound engine controls a connected audio output device to mimic the particular note or notes of an instrument as indicated in the sound file.

Storing the sound sample, or waveforms, can necessitate the use of more memory space than is optimal. This is especially so, given that it is sometimes desirable to incorporate a musical sound synthesis capability in a device in which memory allocation is a significant constraint, such as in a hand-held device like a mobile phone. One approach has been to store not the sound data or waveforms themselves, but rather the coefficients or parameters of the waveforms that are representative of the underlying musical sound signals. These coefficients or parameters are then supplied to the sound engine directly so that the desired musical sound can be synthesized.

A particular problem with this approach, especially in the context of a MIDI-conformable device, can be that some or all of the components of the synthesizing device—the sound engine, wave table, and related components—may have to be reconfigured to accommodate the sound engine's processing of the coefficients. An efficient system fails to exist that reduces the memory requirement for carrying out musical sound synthesis, but without necessitating a wholesale or partial reconfiguration of the sound engine, wave table, or other components needed to effect the synthesis.

SUMMARY OF THE INVENTION

Embodiments in accordance with the present invention provide a system for use in synthesizing a sound signal with a sound synthesis engine based upon processing of a sound file. The system, according to one embodiment of the present invention, can include a post-compression coefficient table containing a set of post-compression coefficients, and a waveform module for generating at least one post-compression waveform based upon the set of post-compression coefficients. Each post-compression coefficient belonging to the set of post-compression coefficients can be determined by generating a frequency-domain representation of a periodic signal, where the frequency-domain representation comprises at least one frequency-domain sample, and performing a threshold-based compression of frequency-domain samples if the at least one frequency-domain sample comprises a plurality of frequency-domain samples.

According to another embodiment, the system can further include a sampling module for generating a set of pre-compression samples based upon the periodic signal and a compression module for generating the set of post-compression coefficients based upon the set of pre-compression samples. The system also can include a read-ahead module for performing a read-ahead operation on the sound file before selecting the at least one post-compression waveform. The read-ahead operation can indicate the at least one post-compression waveform to be selected and supplied to the sound synthesis engine.

Another embodiment is a processor-based method of providing waveforms for use in synthesizing a sound signal with a sound synthesis engine based upon processing of a sound file. The method can include selecting at least one post-compression waveform from a post-compression waveform table, and supplying the at least one post-compression waveform to the sound synthesis engine.

Yet another embodiment of the present invention pertaining to a method of providing waveforms further includes indexing and storing each post-compression coefficient belonging to the set of post-compression coefficients in a post-compression coefficient table. The method additionally can include generating the at least one post-compression waveform based upon the set of post-compression coefficients, and placing the at least one post-compression waveform in the compression waveform table prior to the selecting. The method further can include performing a read-ahead operation on the sound file before selecting the at least one post-compression waveform, the read-ahead operation indicating the at least one post-compression waveform to be selected and supplied to the sound synthesis engine.

BRIEF DESCRIPTION OF THE DRAWINGS

There are shown in the drawings, example embodiments, it being understood, however, that the invention is not limited to the precise arrangements and instrumentalities shown.

DETAILED DESCRIPTION OF THE INVENTION

The present invention provides a system for synthesizing a sound signal in response to instructions contained in a sound file. The sound signal corresponds to one or more musical notes as generated by a particular musical instrument. The sound file, for example, can be a file configured in accordance with the Musical Instrument Digital Interface (MIDI) protocol. The system utilizes a waveform table that, as explained herein, can be employed to reduce or limit memory storage requirements for effecting the synthesis of the sound signal. More particularly, the system creates a resource-constrained waveform table using a compression routine, the resulting waveform table comprising waveforms usable by a standard sound synthesis engine such as a MIDI-compatible device for generating a desired sound signal.

Figure 1:
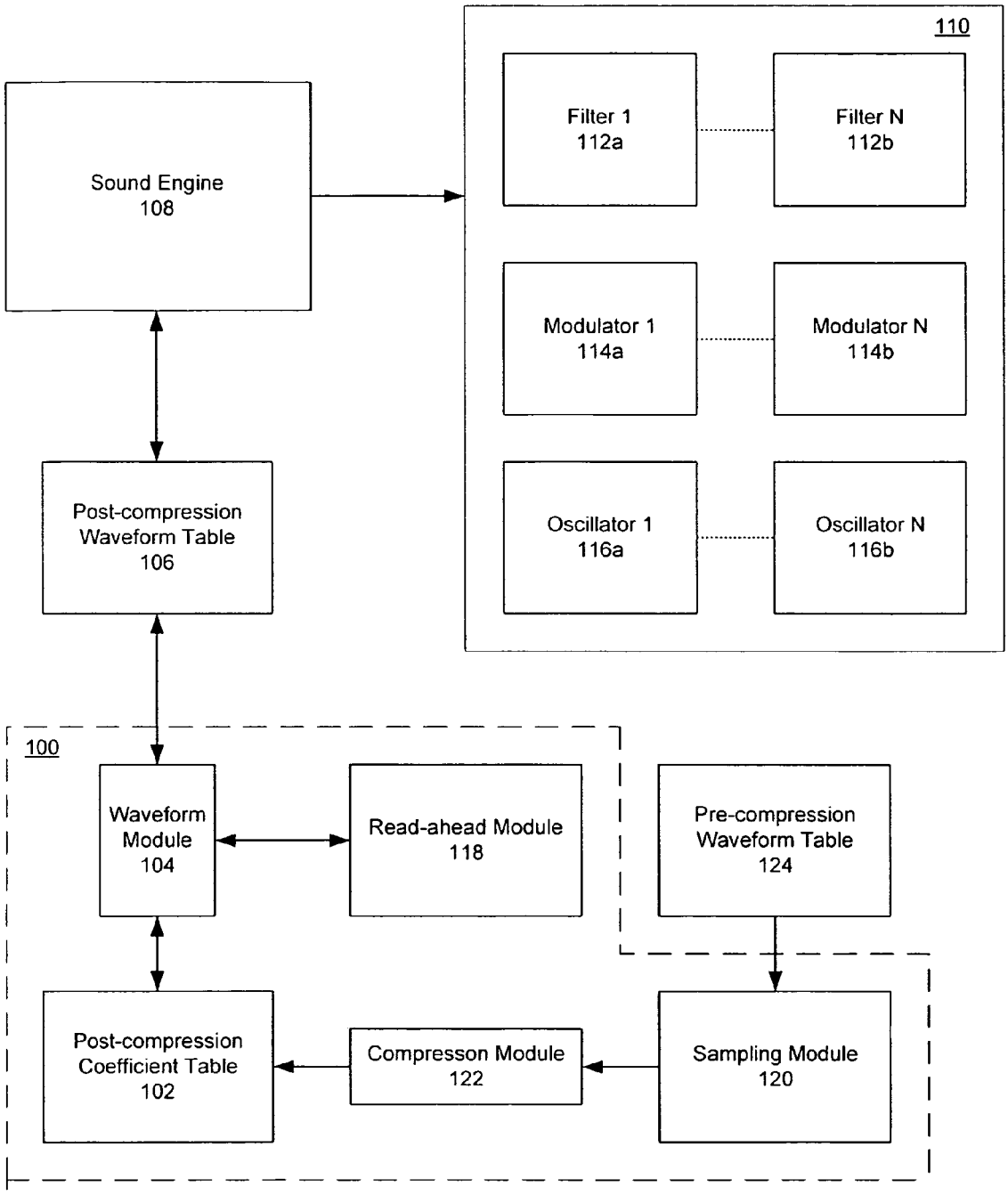
FIG. 1 is a schematic diagram of a system for use in synthesizing a musical sound signal according to one embodiment of the present invention.

FIG. 1 illustrates a system 100 according to one embodiment of the present invention. As illustrated, the system 100 includes a post-compression coefficient table 102 for storing a set of post-compression coefficients, and a waveform module 104 for generating at least one post-compression waveform based upon the set of post-compression coefficients. The set of post-compression coefficients contains one or more post-compression coefficients that have been determined according to a manner described in detail below.

The system 100 as illustrated is configured to communicate electronically with a post-compression waveform table 106. The post-compression waveform table 106 illustratively comprises a memory for storing post-compression waveforms generated by the waveform module 104 of the system 100. As further illustrated, the waveform table 106, in turn, is configured to communicate electronically with a standard sound engine 108 so that the post-compression waveforms generated by the waveform module 104 of the system 100 can be retrieved by the sound engine. The sound engine 108 is thus able to electronically process a sound file (not shown) containing electronic instructions for synthesizing a desired sound.

The sound engine 108 is connected to a standard sound output device 110 comprising a plurality of filters 112*a*, 112*b*, a plurality of modulators 114*a*, 114*b*, and a plurality of oscillators 116*a*, 116*b*. As directed by the sound engine 108 in accordance with the sound file processed by the sound engine, the sound output device 110 converts electronic signals corresponding to the post-compression waveforms into audible acoustic signals, as will be readily understood by one of ordinary skill in the art. More particularly, the sound file indicates that a sound of a particular note or series of notes performed by a particular musical instrument is to be synthesized. The sound engine 108 responds by selecting the appropriate post-compression waveform stored in the waveform table 106 and, based thereon, causing the sound output device 110 to synthesize the desired sound.

The system 100 as illustrated also includes a read-ahead module 118 for performing a read-ahead operation on the sound file before the selecting of the appropriate waveform by the sound synthesis engine 108. The read-ahead operation indicates the waveform that is about to be selected by the sound synthesis engine 108 so as to cause the sound output device to 110 generate the desired musical sound indicated by the sound file. As such, the waveform need not be previously stored at this point. Rather, the system 100 responds, based on the read-ahead operation having determined the particular waveform that is about to be selected, by causing the waveform module 104 to generate a post-compression waveform using the appropriate post-compression coefficients. The post-compression waveform is then placed in the post-compression waveform table where it then can be retrieved by the sound synthesis engine 108. The post-compression waveform, having been generated on the basis of the post-compression coefficients, contains the necessary information for the sound synthesis engine 108 to cause the sound output device 110 to generate the desired musical sound.

As explained in more detail hereinafter, the set of post-compression coefficients will have been determined by generating a frequency-domain representation of a periodic signal, the frequency-domain representation comprising at least one frequency-domain sample, and then performing a threshold-based compression of frequency-domain samples if the at least one frequency-domain sample comprises a plurality of frequency-domain samples. Accordingly, the system 100 optionally includes a sampling module 120 for generating a set of pre-compression samples based upon the periodic signal, along with a compression module 122 for generating the set of post-compression coefficients based upon the set of pre-compression samples. The periodic signals can be retrieved by the sampling module 120 from a standard waveform table, illustratively shown as a pre-compression waveform table 124.

The system 100 does not necessarily have to store the waveforms until after the read-ahead operation has been performed by the read-ahead module 118. Instead, the waveform, as a post-compression waveform, is generated by the waveform module 104 using the post-compression coefficients only after the read-ahead operation has been performed, the post-compression coefficients being the only values that need be stored prior to the performance of the read-ahead operation. This can effect a significant savings in the resources needed for storing the information needed for synthesizing the desired musical sound. Moreover, the post-compression coefficients, by virtue of their having been compressed in a manner explained in detail below, effects an even more pronounced reduction in the associated memory storage.

Additionally, although the post-compression coefficients are used in generating post-compression waveforms, they are not supplied directly to the sound synthesis engine 108. Instead, the post-compression coefficients are used to generate post-compression waveforms that are then stored in a standard wave table just prior to their being needed by the sound synthesis engine 108. When the sound synthesis engine 108 requires a waveform it merely retrieves it from a standard waveform table as it ordinarily would without any modification. This provides considerable universality to the system 100, since it permits the system to be used with a standard waveform table and standard sound synthesis engine without having to modify either.

Accordingly, the system 100 can provide memory resource savings to a standard sound synthesizer without the standard sound synthesizer having to be first modified to achieve such advantages. For example, the system 100 can be used in a standard MIDI wave synthesis system comprising a standard MIDI waveform table and MIDI sound engine to effect a reduction in the memory requirements without having to modify either the MIDI waveform table structure or the MIDI sound engine. That is, the content of the standard MIDI waveform table can be stripped out, and in lieu thereof, the system 100 will store the much less memory-intensive set of post-compression coefficients in the post-compression coefficients table 102 just as the ordinary MIDI waveforms would have been. Relying on the determination made by the read-ahead module 118 regarding which waveform will soon be required by the MIDI sound engine, the waveform module 104 of the system 100 generates a compressed waveform that can be placed in the standard MIDI wave table. When the MIDI sound engine, operating as it ordinarily would, accesses the MIDI wave table, the needed waveform is there, albeit in the form of a post-compression waveform.

As will be readily appreciated by one of ordinary skill in the art, each of the elements of the system 100 can be implemented in the form of software-based modules configured to operate in conformance with a particular protocol, such as the MIDI protocol. The system 100, accordingly, can be configured to run on a general purpose computer or on a special-purpose device having processing capabilities such as a hand-held mobile phone that includes a processor. Alternately, however, the system 100 can implemented in one or more hardwired circuits comprising, for example, logic gates and memory. As will also be readily appreciated by one of ordinary skill in the art, the system 100 alternatively can be implemented as a combination of software-based instructions and dedicated hardwire circuitry.

Figure 2:
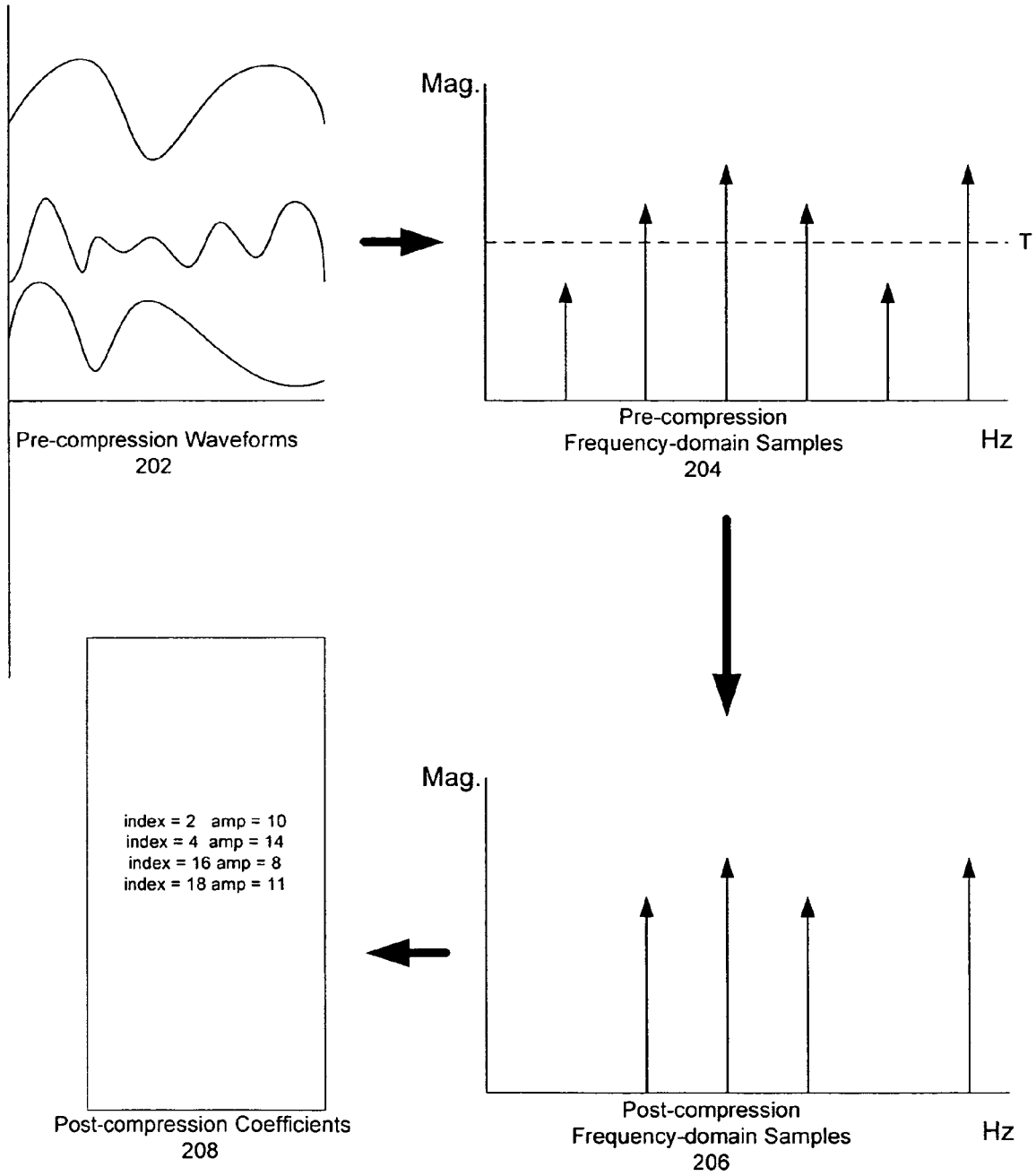
FIG. 2 is a schematic diagram of operative steps performed by the system illustrated in FIG. 1.

Referring additionally now to FIG. 2, a manner for determining the post-compression coefficients is described. The frequency-domain representation of the post-compression coefficients is derived from a periodic signal that corresponds to the musical note generated by a particular musical instrument, the note and instrument being those specified in the sound file for synthesizing by the sound synthesis engine. Musical sounds typically comprise periodic signals. Accordingly, they can be represented as a sum of harmonically related complex exponentials using, for example, the mathematical techniques of Fourier analysis. For example, as has been demonstrated by the inventors of the present invention, a musical sound such as the "A" note of a piano can be synthesized on the basis of the first three harmonics of the fundamental frequency at 440 HZ subjected to proper scaling and a four-part envelope shaping.

As illustrated in FIG. 2, a pre-compression periodic signal is selected from among a plurality of stored periodic signals 202, the selection as already described being dictated by the sound file and indicated by the read-ahead operation. Next, frequency-domain samples 204 representative of the periodic signal are obtained. Preferably, the frequency domain samples 204 are obtained by the sampling module 120 implementing a fast Fourier transform (FFT), as will be readily understood by one of ordinary skill in the art. The frequency domain samples 204, more preferably, are obtained by implementing a discrete-time FFT, as will also be readily understood by one of ordinary skill in the art.

Having obtained the frequency domain samples 204, the samples then undergo a compression procedure based upon the magnitudes of the samples. More particularly, the amplitudes of each sample are compared to a threshold, T. Those samples whose magnitudes are less than T are excluded, and those samples 206 whose magnitudes are at least equal to T are used to construct post-compression coefficients 208. As illustrated, the post-compression coefficients 208 are then indexed and stored as indexed amplitudes of the post-compression samples 206.

The pre-compression waveforms, thus, can comprise replicates of waveforms stored in a pre-compression waveform table. It follows that, as alluded to above, an embodiment of a system according to the present invention can be used in conjunction with a standard MIDI waveform table and standard MIDI sound engine. The periodic signals, then, correspond to those contained in a standard MIDI wave table. The system, however, need only use the standard waveform table once to produce the post-compression coefficients, which are then stored to be used in the manner described above. That is, the standard MIDI waveforms contained in the MIDI wave table provide the periodic signals that are the basis from which the post-compression coefficients are derived.

Figure 3:
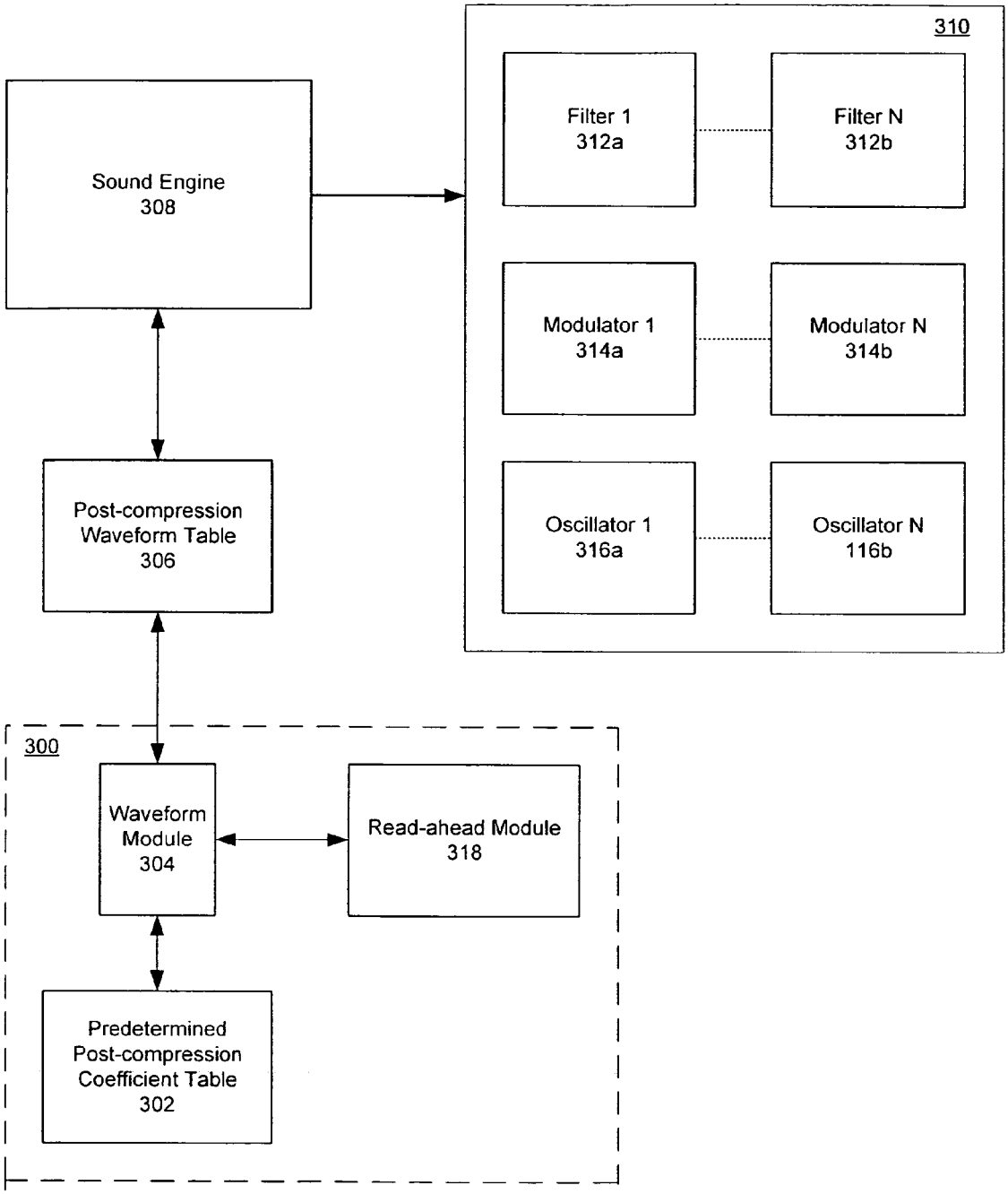
FIG. 3 is a schematic diagram of a system for use in synthesizing a musical sound signal according to another embodiment of the present invention.

Thus, according to another embodiment of the present invention, illustrated in FIG. 3, the system 300 can include a predetermined post-compression coefficient table 302, the post-compression coefficients contained therein having been determined in advance of the system's operation based on the standard waveforms of a standard waveform table, such as a MIDI waveform table. The predetermined coefficients are used by the waveform module 304 to generate post-compression waveforms stored in a post compression wave table 306 and usable by the sound engine 308, such as a standard MIDI sound engine, in synthesizing a desired musical signal in response to a MIDI sound file, the MIDI sound file being subjected to a read-ahead operation performed by the read-ahead module 318 as described above. The actual sound, as described previously, is generated by a generic sound output device 310 comprising a plurality of filters 312*a*, 312*b*, a plurality of modulators 314*a*, 314*b*, and a plurality of oscillators 316*a*, 316*b*.

In still another embodiment of the present invention, the predetermined post-compression coefficient table can include coefficients derived from periodic signals that are replicates of the actual waveforms of pre-selected musical notes performed by a pre-selected musical instrument. Deriving the coefficients from waveforms of notes actually performed by a musical instrument provides a set of frequency-related parameters that lend enhanced quality to the musical sounds synthesized.

Figure 4:
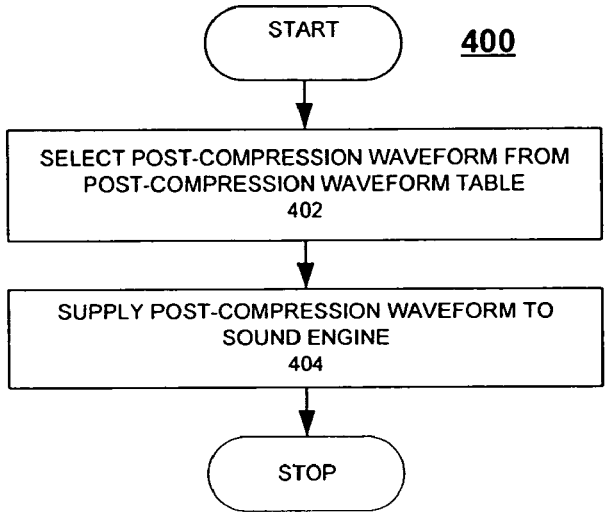
FIG. 4 is a flowchart of a method used in connection with synthesizing a musical sound signal according to still another embodiment of the present invention.

Referring to FIG. 4, a flowchart illustrative of a method 400 in accordance with an embodiment of the present invention is shown. The method 400 is a processor-based method of providing waveforms for use in synthesizing a sound signal with a sound synthesis engine in response to a processor processing a sound file. The method 400 illustratively includes at step 402 selecting at least one post-compression waveform from a post-compression waveform table. The method further includes at step 404 supplying the at least one post-compression waveform to the sound synthesis engine, wherein the at least one post-compression waveform is based upon a set of post-compression coefficients that have been generated by generating a frequency-domain representation of a periodic signal and performing a threshold-based compression.

Figure 5:
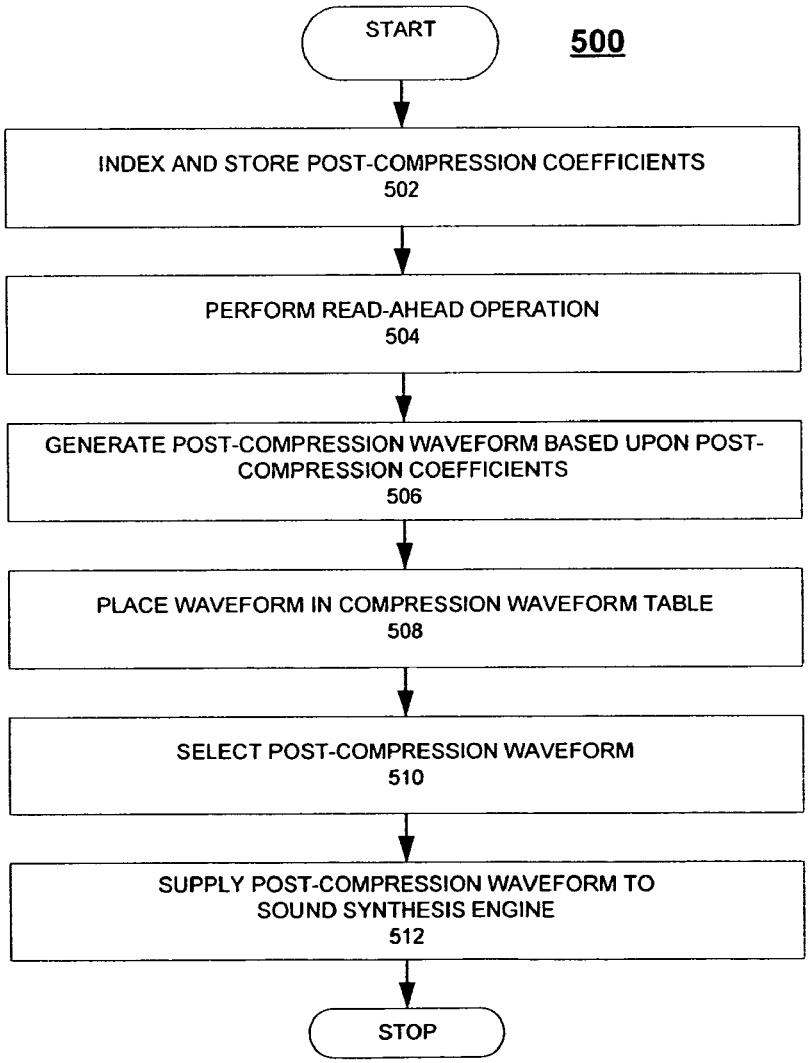
FIG. 5 is a flowchart of a method used in connection with synthesizing a musical sound signal according to yet another embodiment of the present invention.

Referring to FIG. 5, a flowchart illustrative of a method 500 in accordance with another embodiment of the present invention and also pertaining to a processor-based method of providing waveforms for use in synthesizing a sound signal with a sound synthesis engine in response to a processor processing a sound file. The method 500 includes at step 502 indexing and storing each post-compression coefficient belonging to the set of post-compression coefficients in a post-compression coefficient table. At step 504, a read-ahead function is performed on the sound file to determine which musical sound is to be synthesized and, accordingly, the particular waveform that will need to be retrieved by the sound synthesis engine.

The method 500 at step 506 generates the indicated post-compression waveform, the post-compression waveform being generated based upon the set of post-compression coefficients. The post-compression waveform is then placed in the compression waveform table at step 508 prior to the selecting. With the post-compression waveform now placed in the post-compression waveform table, it is available to the sound synthesis engine. At step 510, the post-compression waveform is selected so that it can be supplied to the sound synthesis engine at step 512. The post-compression waveform is then used to synthesize the desired musical note.

As already noted, the present invention can be realized in hardware, software, or a combination of hardware and software. The present invention also can be realized in a centralized fashion in one computer system, or in a distributed fashion where different elements are spread across several interconnected computer systems. Any kind of computer system or other apparatus adapted for carrying out the methods described herein is suited. A typical combination of hardware and software can be a general purpose computer system with a computer program that, when being loaded and executed, controls the computer system such that it carries out the methods described herein.

The present invention also can be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

This invention can be embodied in other forms without departing from the spirit or essential attributes thereof. Accordingly, reference should be made to the following claims, rather than to the foregoing specification, as indicating the scope of the invention.

What is claimed is:

1. A processor-based method of providing waveforms for use in synthesizing a sound signal with a sound synthesis engine based upon processing of a sound file, the method comprising:

performing a read-ahead operation on the sound file during the synthesizing of the sound signal;

identifying an instruction in the sound file for synthesizing a waveform of a musical instrument;

finding an index of the waveform in a waveform table used by the sound synthesis engine;

selecting a set of post-compression coefficients in a post-compression coefficient table corresponding to the index;

generating at least one post-compression waveform from the set of post-compression coefficients;

placing the at least one post-compression waveform at the index in the waveform table; and supplying the at least one post-compression waveform to the sound synthesis engine in advance of the sound synthesis engine requesting the waveform;

wherein the at least one post-compression waveform is based upon the set of post-compression coefficients, the set of post-compression coefficients having been determined by generating a frequency-domain representation of a periodic signal, the frequency-domain representation comprising at least one pre-compression frequency-domain sample, and performing a threshold-based compression of pre-compression frequency-domain samples if the at least one pre-compression frequency-domain sample comprises a plurality of pre-compression frequency-domain samples.

2. The method of claim 1, further comprising:

indexing and storing each post-compression coefficient belonging to the set of post-compression coefficients in the post-compression coefficient table prior to synthesizing the sound signal; and replacing the waveform table with the post-compression coefficient table prior to synthesizing the sound signal, wherein the sound synthesis engine indexes the at least one post-compression waveform in the post-compression coefficient table at a location corresponding to the index of the waveform in the waveform table.

3. The method of claim 1, wherein the frequency-domain representation is based upon a fast Fourier transform (FFT) of the periodic signal.

4. The method of claim 3, wherein the at least one waveform is based upon an inverse FFT using the set of post-compression coefficients.

5. The method of claim 1, wherein the sound file and the compression waveform table each conform to a Musical Instrument Digital Interface (MIDI) protocol.

6. The method of claim 1, wherein the frequency-domain representation of a periodic signal is based upon a waveform stored in a pre-compression waveform table.

7. The method of claim 1, wherein the frequency-domain representation of a periodic signal is based upon a waveform corresponding to an actual rendering of a pre-selected musical note by a pre-selected musical instrument.

8. A system for use in synthesizing a sound signal with a sound synthesis engine based upon processing of a sound file, the system comprising:

a post-compression coefficient table containing at least one set of post-compression coefficients representing a waveform in a waveform table, wherein an index of the waveform in the waveform table corresponds to the set of post-compression coefficients in the post-compression coefficient table; and a waveform module for generating at least one post-compression waveform based upon the set of post-compression coefficients at the index in the post-compression coefficient table;

wherein each post-compression coefficient belonging to the set of post-compression coefficients has been determined by generating a frequency-domain representation of a periodic signal, the frequency-domain representation comprising at least one frequency-domain sample, and performing a threshold-based compression of frequency-domain samples if the at least one frequency-domain sample comprises a plurality of frequency-domain samples.

9. The system of claim 8, further comprising:

a sampling module for generating a set of pre-compression samples based upon the periodic signal; and a compression module for generating the set of post-compression coefficients based upon the set of pre-compression samples.

10. The system of claim 8, further comprising a read-ahead module for performing a read-ahead operation on the sound file before selecting the at least one post-compression waveform, the read-ahead operation indicating the at least one post-compression waveform to be selected and supplied to the sound synthesis engine.

11. The system of claim 8, wherein the frequency-domain representation is based upon a fast Fourier transform (FFT) of the periodic signal.

12. The system of claim 11, wherein the at least one waveform is based upon an inverse FFT performed using the set of post-compression coefficients.

13. The system of claim 8, wherein the sound file and the compression waveform table each conform to a Musical Instrument Digital Interface (MIDI) protocol.

14. The system of claim 8, wherein the periodic signal is a replicate of a waveform stored in a pre-compression waveform table.

15. The system of claim 8, wherein the periodic signal is a replicate of a waveform based upon an actual rendering of a pre-selected musical note by a pre-selected musical instrument.

16. A computer-readable storage medium for use in synthesizing a sound signal with a sound synthesis engine in response to a processor processing a sound file, the storage medium comprising computer instructions for:

performing a read-ahead operation on the sound file during the synthesizing of the sound signal;

identifying an instruction in the sound file for synthesizing a waveform of a musical instrument;

finding an index of the waveform in a waveform table used by the sound synthesis engine;

selecting a set of post-compression coefficients in a post-compression coefficient table corresponding to the index;

generating at least one post-compression waveform from the set of post-compression coefficients;

placing the at least one post-compression waveform at the index in the waveform table; and supplying the at least one post-compression waveform to the sound synthesis engine in advance of the sound synthesis engine requesting the waveform;

wherein the at least one post-compression waveform is based upon a set of post-compression coefficients, the set of post-compression coefficients having been determined by generating a frequency-domain representation of a periodic signal, the frequency-domain representation based upon a fast Fourier transform (FFT) of the periodic signal and comprising at least one pre-compression frequency-domain sample, and performing a threshold-based compression of pre-compression frequency-domain samples if the at least one pre-compression frequency-domain sample comprises a plurality of pre-compression frequency-domain samples.

17. The computer-readable storage medium of claim 16, further comprising computer instructions for:

indexing and storing each post-compression coefficient belonging to the set of post-compression coefficients in the post-compression coefficient table prior to synthesizing the sound signal; and replacing the waveform table with the post-compression coefficient table prior to synthesizing the sound signal, wherein the sound synthesis engine indexes the at least one post-compression waveform in the post-compression coefficient table at a location corresponding to the index of the waveform in the waveform table.

* * * * *